US010975698B2

(12) United States Patent
Guan

(10) Patent No.: US 10,975,698 B2
(45) Date of Patent: Apr. 13, 2021

(54) CLOSED CYCLE ENGINE POWER STRUCTURE AND POWER GENERATION METHOD

(71) Applicant: Weiwei Guan, Maoming (CN)

(72) Inventor: Weiwei Guan, Maoming (CN)

( * ) Notice: Subject to any disclaimer, the term of this patent is extended or adjusted under 35 U.S.C. 154(b) by 0 days.

(21) Appl. No.: 16/447,249

(22) Filed: Jun. 20, 2019

(65) Prior Publication Data

US 2020/0049009 A1 Feb. 13, 2020

(30) Foreign Application Priority Data

Aug. 10, 2018 (CN) ..... 201810908077.7

(51) Int. Cl.
*F01B 23/10* (2006.01)
*F01B 1/06* (2006.01)
*F01B 31/28* (2006.01)

(52) U.S. Cl.
CPC ..... *F01B 23/10* (2013.01); *F01B 1/0679* (2013.01); *F01B 31/28* (2013.01)

(58) Field of Classification Search
CPC ..... F01B 23/10; F01B 1/0679; F01B 23/08; F01B 31/28
USPC ..... 290/1 A
See application file for complete search history.

(56) References Cited

U.S. PATENT DOCUMENTS 2,017,481 A * 10/1935 Von Opel ..... F02B 47/10 123/1 R
3,224,187 A * 12/1965 Breihan ..... F03G 6/06 60/526
3,613,368 A * 10/1971 Doerner ..... F01K 11/04 60/657
4,344,479 A * 8/1982 Bailey ..... F22B 7/00 165/109.1
5,209,650 A * 5/1993 Lemieux ..... F01D 15/10 384/115
6,741,000 B2 * 5/2004 Newcomb ..... F04D 3/02 290/54
7,937,943 B2 5/2011 Cao
8,558,424 B2 * 10/2013 Auten ..... F03B 13/10 310/90.5
2012/0106297 A1 * 5/2012 Fraser ..... E21B 41/0085 367/83

(Continued)

FOREIGN PATENT DOCUMENTS

CN 1184205 A 6/1998
CN 103437970 A 12/2013

*Primary Examiner* — Charles Reid, Jr.
(74) *Attorney, Agent, or Firm* — Erson IP (Nelson IP)

(57) ABSTRACT

A closed cycle engine power structure and a power generation method, includes a cylinder block and an inner shell. The inner shell is located at the cylinder block, and the inner enclosed cavity of the cylinder block is divided into an outer duct and an inner duct, and an electric coil is arranged in the inner shell. An Archimedes pump is arranged in the inner duct, the electric coil is in drive connection with the Archimedes pump to form a motor structure. Tension structures are arranged in the outer duct. The Archimedes pump is driven to rotate to form a pressure difference between the top and bottom of the cylinder block, generating airflow around the tension structures. According to Bernoulli principle, the pulling force is generated by tension structures. The tension structures concentrate on the cylinder block to form the power of the engine power structure.

8 Claims, 4 Drawing Sheets

(56) References Cited

U.S. PATENT DOCUMENTS

| | | | | |
|---|---|---|---|---|
| 2012/0149944 | A1* | 6/2012 | Zmierczak | B01J 8/22 568/698 |
| 2012/0169057 | A1* | 7/2012 | Tonkin | F03B 17/061 290/54 |
| 2014/0230401 | A1 | 8/2014 | Dunn | |
| 2016/0040495 | A1* | 2/2016 | Mahajan | E21B 10/42 166/376 |
| 2016/0207600 | A1 | 7/2016 | Grossman | |
| 2019/0301591 | A1* | 10/2019 | Pritchard | F16H 57/0446 |

* cited by examiner

CLOSED CYCLE ENGINE POWER STRUCTURE AND POWER GENERATION METHOD

CROSS-REFERENCE TO RELATED APPLICATIONS

This application claims priority to Chinese Patent Application No. 201810908077.7 with a filing date of Aug. 10, 2018. The content of the aforementioned applications, including any intervening amendments thereto, are incorporated herein by reference.

TECHNICAL FILED

The present invention relates to the technical field of engine driving, in particular to a closed cycle engine power structure and a power generation method.

BACKGROUND OF THE PRESENT INVENTION

At present, main vehicles are motorcycles and automobiles, whose power components mainly use fuel engines or electric engines. All vehicles share a common feature, that is, needs a force to pull them forward.

At present, main power engines on the market are fuel engines and electric engines. Fuel engine is mainly converted into mechanical energy by burning chemical energy such as oil. The energy utilization rate is quite low because of conversion efficiency and transmission efficiency. And it is difficult to start in high humidity or low temperature weather, extremely when it is more prone to fail started the fuel engine in worse rainy weather, water immersion or so on. At the same time, the fuel engine needs high temperature and high pressure resistance, which makes the material cost high.

The principle of the electric engine is to convert electrical energy into mechanical energy, due to the influence of transmission and other aspects, and the energy utilization rate is also quite low. And both fuel engine and electric engine are using transmission shaft to transfer energy to the wheel, so as to generate a forward force. To transmit power to the tires, there are not only problems of transmission efficiency, but also problems such as gear wear and the like.

SUMMARY OF THE INVENTION

The present invention provides a closed cycle engine power structure and a power generation method in order to overcome at least one defect or shortcoming of the above existing technology.

To solve the above technical problems, the technical solution, of the present invention is as follows:

A closed cycle engine power structure, including a cylinder block and an inner shell, the inner shell is located at the center of the cylinder block, and the inner enclosed cavity of the cylinder block is divided into an outer duct and an inner duct. An electric coil is arranged in the inner shell, and an Archimedes pump is arranged in the inner duct. The electric coil and the Archimedes pump are in drive connection to form a motor structure. The electric coil drives the Archimedes pump to rotate by connecting to an external power source. The outer duct is disposed with a plurality of tension structures, each of the tension structures includes a horizontal baffle and a tension chamber, two sides of the horizontal baffle are respectively connected to an inner wall of the cylinder block and an outer wall of the inner shell, and the tension chamber is uniformly fixed on the horizontal baffle. A path for air circulation is arranged between each of tension chambers and the horizontal baffles.

The key point of the present invention is to arrange an inner shell in the cylinder block to divide the enclosed internal space into an inner duct and an outer duct, and add Archimedes pump and tension structures into the cylinder block, to pump the air from the bottom of the cylinder block to the top through the inner duct to form a higher pressure area in the top and a lower pressure area in the bottom, so as to form an airflow via the outer duct due to the pressure difference between the top and the bottom. The air flow around the tension chamber arranged in the outer duct is fast, according to the Bernoulli principle, the air with a fast velocity rate has a smaller external pressure on the upper surface of the tension chamber, where the inner and outer pressure difference causes a pulling force generated in the tension chamber which the direction is opposite to the airflow in the outer duct. The pulling forces formed by tension chambers are concentrated on the cylinder block to form a force of the engine for moving.

Furthermore, the tension chamber is hemispherical and is provided with a closed cavity inside. Of course, the tension chamber can also be ellipsoid or other shapes which can satisfy the decompression condition of Bernoulli principle.

Furthermore, the plurality of tension structures are distributed in equidistance along an axis of the outer duct. The location distribution of the tension structures meets the optimal situation according to the air pressure, including the situation that the adjacent tension structures in the axis of the upper and lower planes are staggering or aligned to each other. The tension chamber is hemispherical, that is, the upper part is spherical, the lower part is plane, and the interior of the tension chamber is an enclosed cavity. Surely, the tension chamber can also be ellipsoid or other shapes which can satisfy the decompression condition of Bernoulli principle.

Furthermore, the inner shell includes the electric coil, the casing and several support members. A hollow chamber configured for accommodating the electric coil is arranged in the casing. The casing is connected to the cylinder block by several support members, and the support member is a small hollow cylinder, which is configured to support the casing. The electric coil is placed in the casing, and is connected with external power source through the inner hollow space of the support members, that makes the support member acts as a line channel at the same time. The outer duct and the inner duct are connected in a large area outside the support members for air circulation.

Furthermore, the cylinder block includes an upper cylinder block and a lower cylinder block, and the upper cylinder block and the lower cylinder block are butted to form a cylinder block structure. When installing or repairing, the cylinder block can be separated into upper and lower cylinder blocks.

Furthermore, the Archimedes pump is arranged in the inner duct of the casing, and the Archimedes pump includes an iron core and a plurality of helical surfaces. Each of helical surfaces is fixedly socketed on the iron core at equal intervals, so as to divide the inner duct into a plurality of rotating acceleration chambers. Considering the power requirement of the motor, the Archimedes pump is a rotator of the motor, and a small number of wirings can be added outside the pump body to optimize the rotational speed, for example, it can add wirings outside the pump in the axial direction to form an electric cage structure.

In operation, the iron core is driven to rotate by the electric coil, so as to drive the helical surface to rotate, and the air at the bottom of the cylinder block is pumped from the one rotating acceleration chamber into another rotating acceleration chamber in the top direction in the way of spiral. When each revolution of the Archimedes pump rotates, the air in the rotating acceleration chamber is pushed forward by a pitch. The pitch can be set to 10 cm, although other suitable lengths are also possible. After the air in the cylinder block is accelerated by the Archimedes pump, a higher pressure area is formed at the top of the cylinder block, and a lower pressure area is formed at the bottom of the cylinder block. Due to the difference in air pressure, it generates airflow via the outer duct, from the top of the cylinder block to the bottom. The pressure on the top of tension chamber is reduced when the airflow is blown around increasing the velocity of airflow. A pressure difference compared to the air in the internal cavity of the tension chamber is formed. In the tension chamber a pulling force which the direction is opposite to the airflow in the outer duct is generated. The pulling forces formed by tension chambers are concentrated on the cylinder block to form a force of the engine for moving.

In addition, the present invention also provides a power generation method of a closed cycle engine, which adopts the power structure of the closed cycle engine. The method includes the steps as following: S1. butting an upper cylinder block with a lower cylinder block to form the cylinder block, wherein an enclosed inner cavity is formed in an interior of the power structure of the engine; S2. powering on a motor structure to connect with an external power supply to drive an Archimedes pump to rotate; S3. Pumping air in the inner duct from the bottom of the inner duct to the top of the inner duct by the Archimedes pump to form a higher pressure area in the top of the inner duct and a lower pressure area in the bottom of the inner duct, wherein an airflow generates from the top of inner duct to the bottom of inner duct via the outer duct, S4. the pressure on the top of tension chamber is reduced when the airflow is blown frontally to the tension chamber increasing the velocity of airflow. A pressure difference compared to the air in the internal cavity of the tension chamber is formed. In the tension chamber a pulling force which the direction is opposite to the airflow in the outer duct is generated; S5. The pulling forces formed by tension chambers are concentrated on the cylinder block, so as to generate a force along an axis of the cylinder block to form a force of the engine for moving.

Compared with the prior art, the closed cycle engine power structure and a power generation method provided by the present invention is to add Archimedes pump and tension structures into the cylinder block with enclosed cavity, and the Archimedes pump is driven to rotate by the motor structure to form a pressure difference between the top and bottom of the cylinder block, so as to generate an airflow besides the tension structures. According to Bernoulli principle, the pulling force is generated in the plurality of tension structures, which the direction is opposite to the airflow. The pulling forces formed in tension chambers are concentrated on the cylinder block to form a force of the engine for moving.

Figure 1:
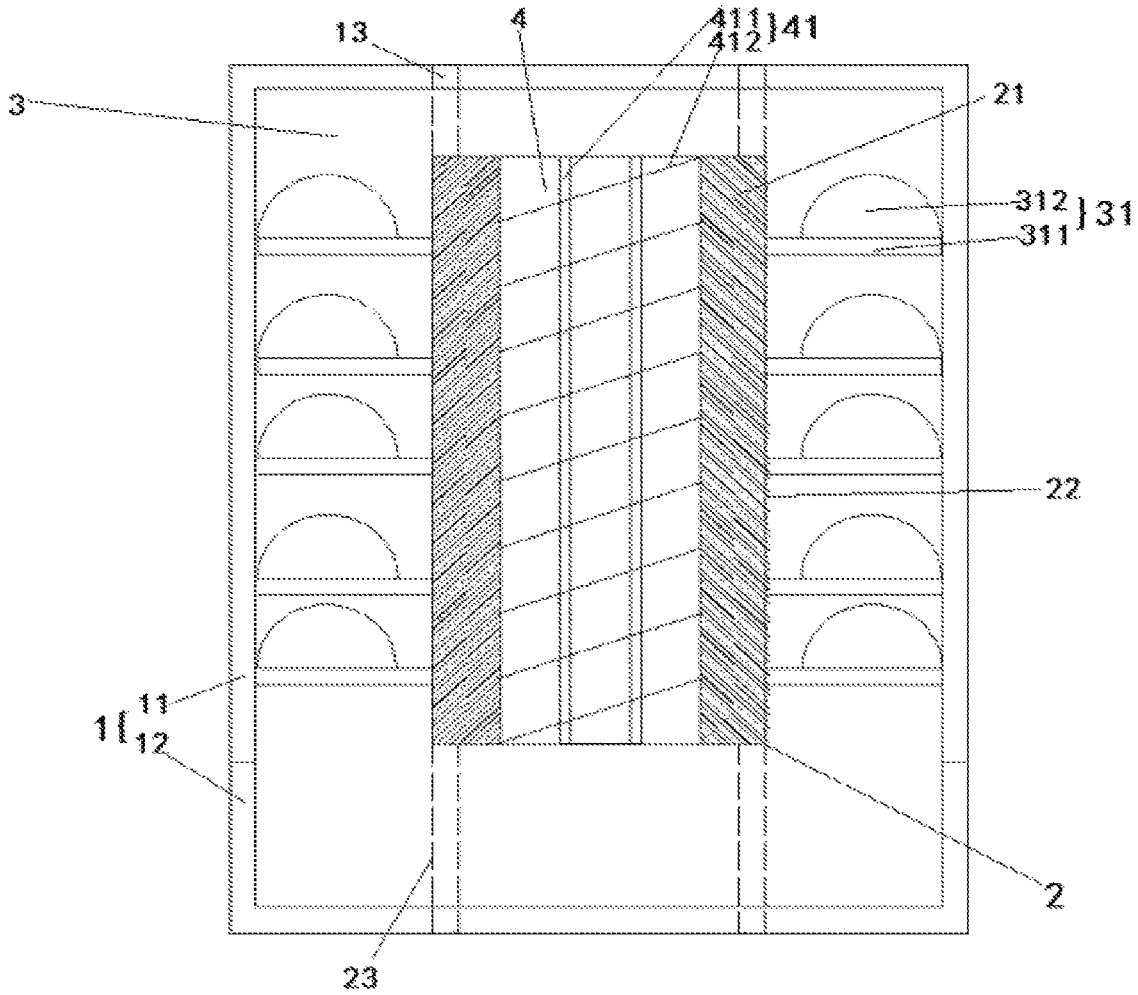
FIG. 1 is a structural view showing the power structure of an embodiment of the present invention.
Figure 2:
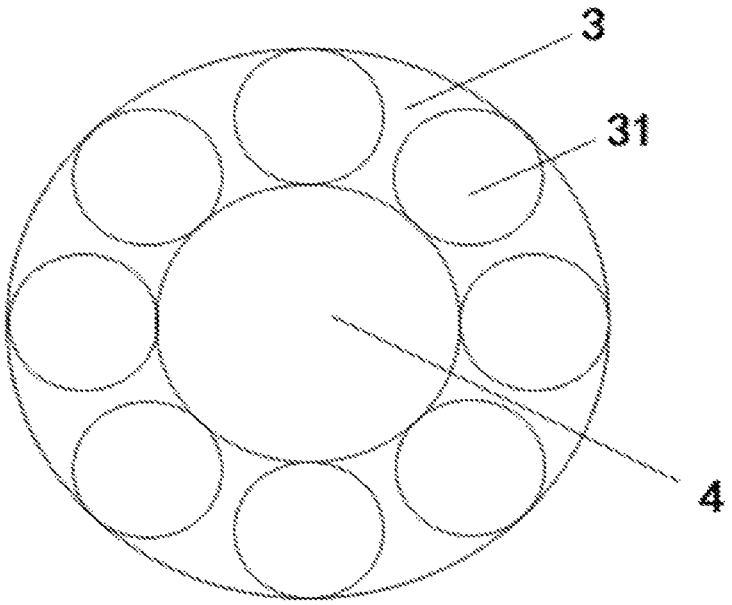
FIG. 2 is a top view showing the power structure of an embodiment of the present invention.
Figure 3:
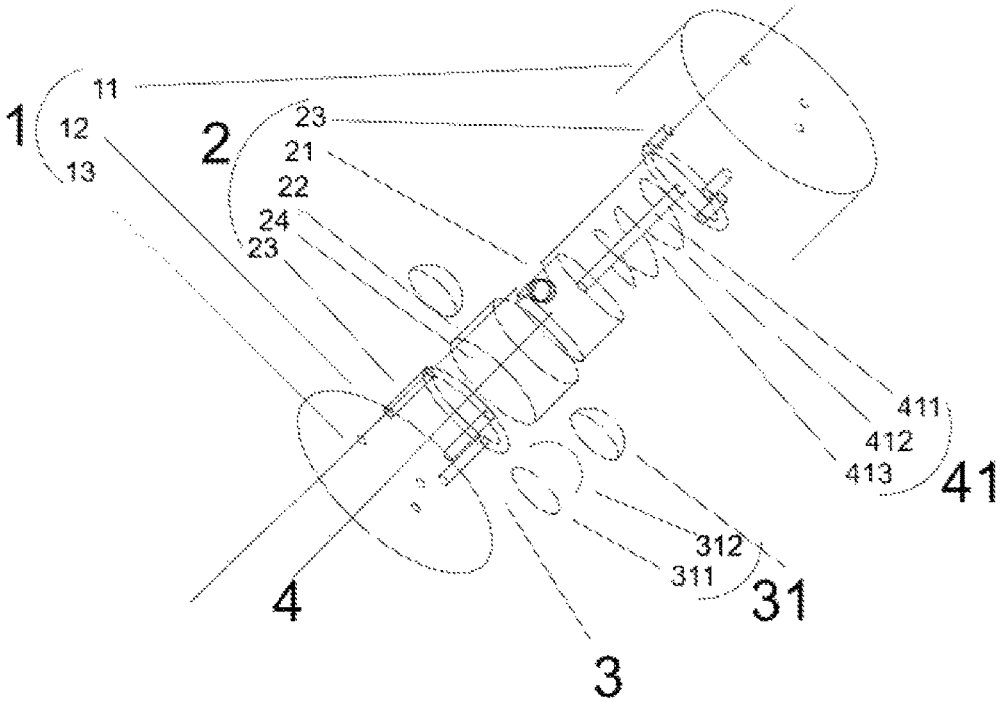
FIG. 3 is an explored stereo view showing the power structure of an embodiment of the present invention.
Figure 4:
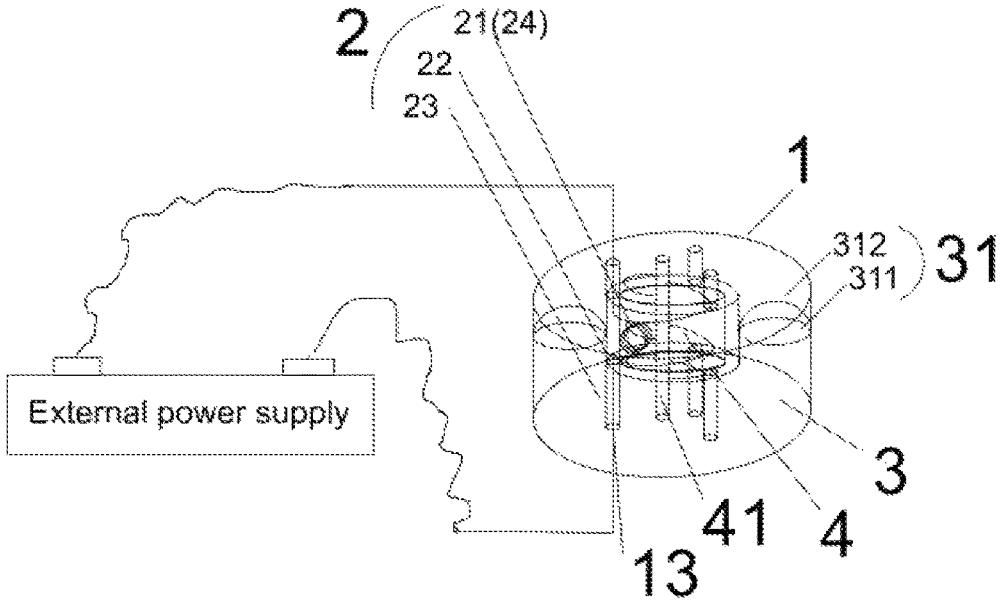
FIG. 4 is a perspective stereo view showing the power structure of an embodiment of the present invention.
Figure 5:
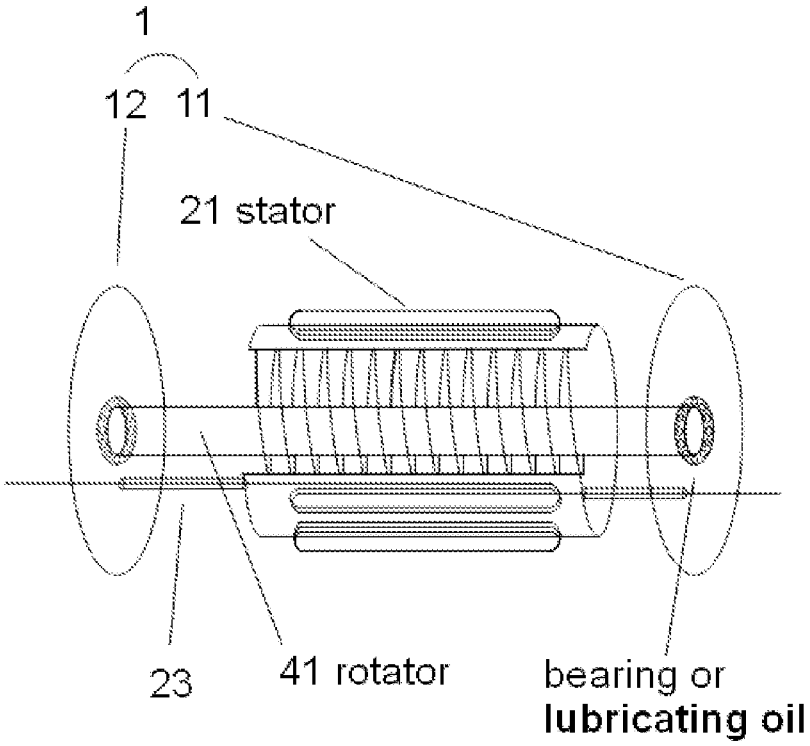
FIG. 5 is a cutaway view to the motor structure, and it only showing components related to the motor structure.

In the drawings 1. cylinder block, 2. inner shell, 3. outer duct, 4. inner duct, 11. Upper cylinder block, 12. lower cylinder block, 13. line channel, 21. electric coil, 22. casing, 23. support member, 31. tension structure, 41. Archimedes pump, 311. horizontal baffle, 312. tension chamber, 411. iron core, 412. helical surface; 413. rotating acceleration chamber; 24. hollow chamber.

DETAILED DESCRIPTION OF THE EMBODIMENTS

In order to facilitate the understanding of those skilled person in the art, the technical solutions of the present invention are further described below in conjunction with the accompanying drawings and embodiments.

Embodiment 1

As shown in FIG. 1, a closed cycle engine power structure includes an inner shell (2) and a cylinder block (1). The inner shell (2) is disposed in the middle of the cylinder block (1), and divides the enclosed internal cavity of the cylinder block (1) into an inner duct (4) and an outer duct (3). The inner shell (2) includes an electric coil (21), a casing (22) and support members (23). A hollow chamber (24) is placed in the casing (22), and the electric coil (21) is disposed in the hollow chamber (24). Several support members (23) are provided which connected the casing (22) and the cylinder block (1), so that the casing (22) is supported inside the cylinder block (1).

The inner duct (4) inside the casing (22) is disposed with an Archimedes pump (41). The Archimedes pump (41) includes an iron core (411) and a plurality of helical surfaces (412). The helical surfaces (412) are fixedly socketed on the iron core at equal intervals, so that the inner duct (4) is divided into a plurality of rotating acceleration chambers (413). At the same time, the Archimedes pump (41) and the electric coil (21) formed a motor structure, and the electrified electric coil (21) drives Archimedes pump (41) to rotate.

As shown in FIGS. 1-5, the outer duct (3) is disposed with a plurality of tension structures (31), and the tension structures (31) are evenly distributed in the outer duct (3) along in the axial direction and the radial direction of the outer duct (3). The tension structure (31) includes a horizontal baffle (311) and a tension chamber (312). The two sides of the horizontal baffles (311) are fixedly connected to the inner wall of the cylinder block (1) and the outer wall of the inner shell (2), respectively, there are air path configured for the airflow flowing between the adjacent tension structure (31), especially the horizontal baffle (311). The tension chamber (312) is hemispherical, and of course, it may be ellipsoid or other shape that satisfies the decompression condition of the Bernoulli principle. In the present embodiment, the tension chamber (312) is hemispherical, that is, the upper part is a sphere and the lower part is a plane. The tension chamber (312) is fixedly disposed on the horizontal baffle (311) and the tension chamber (312) form an enclosed cavity inside. In the axial direction of the outer duct (3), the adjacent tension structures (31) are staggered from each other to ensure that each of the tension chambers (312) has airflow around.

Embodiment 2

The present embodiment is similar to the embodiment 1. Further, as shown in FIG. 1, the cylinder block (1) is formed by butting of the upper cylinder block (11) and the lower cylinder block (12), and can be separated into the upper cylinder block (11) and the lower cylinder block (12) during installation and maintenance, so that the closing and opening of the cylinder block (1) is achieved. The cylinder block (1) and the support member (23) are further configured with a line channel (13) through which the electric coil (21) can be connected to an external power source.

In operation, the electric coil (21) is electrified to drive the iron core (411) to rotated, thereby driving the entire Archimedes pump (41) to rotate, and the air at the bottom of the cylinder block (1) is pumped from one rotating acceleration chamber (413) into another rotating acceleration chamber (413) in the top direction in the way of spiral. The air density in the bottom of cylinder block (1) decreases and the air in the top of the cylinder block (1) increases, a lower pressure area is formed at the bottom and a higher pressure area is formed at the top. Due to the difference in air pressure, it generates airflow via the outer duct (3), which from the top of the cylinder block to the bottom. The airflow flows around the tension chamber (312) and the airflow velocity is increased, so that the air pressure is reduced, and the pressure difference formed comparing to the air in the enclosed cavity inside the tension chamber (312) so as to form a pulling force in the tension chamber which the direction is opposite to the airflow in the outer duct. The pulling force formed by each tension chamber (312) is concentrated on the cylinder block (1) to form a force of the engine for moving.

Embodiment 3

As shown in FIGS. 1-5, a power generation method of a closed cycle engine, which adopts the power structure of the closed cycle engine as mentioned above. The method includes the steps as following: S1. An upper cylinder block (11) is butted with a lower cylinder block (12) to form the cylinder block (1), wherein an enclosed inner cavity is formed in the interior of the power structure of the engine; S2. A motor structure is connected with an external power supply source to drive an Archimedes pump (41) to rotate; S3. The air in the inner duct (4) is pumped from the bottom of the inner duct (4) to the top of the inner duct (4) by the Archimedes pump (41) to form a higher pressure area in the top of the inner duct (4) and a lower pressure area in the bottom of the inner duct (4), wherein an airflow flows via the outer duct (3) from the top of inner duct (4) to the bottom of inner duct (4); S4. the pressure on the top of tension chamber (312) is reduced when the airflow is blown frontally to the tension chamber (312) increasing the velocity of airflow. A pressure difference compared to the air in the internal cavity of the tension chamber (312) is formed. A pulling force opposite to a direction of the airflow in the tension chamber (312) is generated. S5. The pulling forces formed by tension chambers P are concentrated on the cylinder block (1), so as to generate the force along the axis of the cylinder block (1) to form a force of the engine for moving.

Obviously, the above-described embodiments of the present invention are only examples for clearly illustrating the present invention, which are not limitations to the embodiments of the present invention. For the ordinary skilled person in the art, various modifications or changes can be made on the basis of the above description There is no need and no way to exhaust all the implementation methods here. Any modification, equivalent replacement and improvement made within the spirit and principles of the present invention shall be included in the scope of the claims of the present invention.

I claim:

1. A closed cycle engine power structure, comprising a cylinder block (1) and an inner shell (2); the inner shell (2) is located at the center of the cylinder block (1), and an inner enclosed cavity of the cylinder block (1) is divided into an outer duct (3) and an inner duct (4), an electric coil (21) is arranged in the inner shell (2), and an Archimedes pump is arranged in the inner duct (4); wherein the whole power structure, the electric coil (21) and the Archimedes pump (41) are in connection to form a motor structure in which the Archimedes pump (41) can be drive to rotate output; the outer duct (3) is disposed with a plurality of tension structures (31), and the tension structures (31) are evenly distributed in the outer duct (3) along an axial direction and a radial direction of the outer duct (3); the tension structure (31) comprises a horizontal baffle (311) and a tension chamber (312); the two sides of the horizontal baffles (311) are fixedly connected to the inner wall of the cylinder block (1) and the outer wall of the inner shell (2), the tension chamber (312) is fixedly disposed on the horizontal baffle (311); each of the plurality of tension chambers (312) is hemispherical; in an axial direction of the outer duct (3), adjacent tension structures (31) are staggered or aligned from each other to ensure that each of the plurality of tension chambers (312) has airflow around.

2. The closed cycle engine power structure according to claim 1, wherein an interior of each of the plurality of tension chambers (312) is an enclosed cavity.

3. The closed cycle engine power structure according to claim 1, wherein the plurality of tension structures (31) are distributed in equidistance along an axis of the outer duct (3).

4. The closed cycle engine power structure according to claim 1, wherein the inner shell (2) comprises the electric coil (21), a casing (22) and a plurality of support members (23); a hollow chamber configured for accommodating the electric coil (21) is provided in the casing (22); the electric coil (21) is disposed in the hollow chamber; the Archimedes pump (41) is provided in the inner duct (4) which is inside the casing (22); each of the plurality of support members (23) is connected to the casing (22) and the cylinder block (1).

5. The closed cycle engine power structure according to claim 4, wherein the Archimedes pump (41) comprises an iron core (411) and a plurality of helical surfaces (412); each of the plurality of helical surfaces (412) is fixedly socketed on the iron core (411) at equal intervals, so as to divide the inner duct (4) into a plurality of rotating acceleration chambers.

6. The closed cycle engine power structure according to claim 5, wherein the cylinder block (1) comprises an upper cylinder block (11) and a lower cylinder block (12), and the upper cylinder block (1) and the lower cylinder block (12) are butted to form a structure of the cylinder block (1).

7. The closed cycle engine power structure according to claim 6, wherein line channels (13) are provided with holes in the cylinder block (1) and hollow space in the support members (23), and the electric coil (21) is connected to external power supply cables through the line channel (13).

8. A power generation method of a closed cycle engine, of which the characteristics are adopting a power structure of a closed cycle engine characterized by any one of claims 1-7, comprises the following steps:

S1: butting an upper cylinder block (11) with a lower cylinder block (12) to form the cylinder block (1), wherein an enclosed inner cavity is formed in an interior of the power structure of the engine;

S2: powering on a motor structure to connect with an external power supply to drive the Archimedes pump (41) to rotate;

S3: pumping air in the inner duct (4) from the bottom of the inner duct (4) to the top of the inner duct (4) by the Archimedes pump (41) to form a high pressure area in the top of the inner duct (4) and a low pressure area in the bottom of the inner duct (4), thereby an airflow generates via the outer duct (3) from the top of the inner duct (4) to the bottom of the inner duct (4);

S4: a pressure on the top of a tension chamber (312) is reduced when the airflow is blown frontally to the tension chamber (312) increasing the velocity of airflow; forming a pressure difference compared to the air in an internal cavity of the tension chamber (312); generating a pulling force in the tension chamber (312) opposite to the direction of the air flow in the outer duct (3);

S5: concentrating the pulling forces generated in the plurality of tension structures on the cylinder block (1), so as to generate a force along an axis of the cylinder block (1) to form a force of the engine for moving.

* * * * *